US009178305B2

(12) United States Patent
Konietzko et al.

(10) Patent No.: US 9,178,305 B2
(45) Date of Patent: Nov. 3, 2015

(54) ARRANGEMENT FOR ESTABLISHING AND BREAKING A CONNECTION BETWEEN A PLUG AND A MATING PLUG BY PIVOTING LEVER ARRANGED ON THE PLUG

(75) Inventors: Thomas Konietzko, Niederkassel (DE); Stephan Stanke, Rheinbach (DE); Guenter Baujan, Troisdorf (DE); Lothar Winzen, Unkell (DE); Thomas Freyermuth, Kalenborn (DE); Luis Javier Puras Trueba, Mannheim (DE); Rudolf Kraemer, Lautertal (DE); Mohamed Aboulkassem, Darmstadt (DE); Bert Bergner, Bensheim (DE); Christian Schrettlinger, Bensheim (DE)

(73) Assignees: EATON ELECTRICAL IP GMBH & CO. KG, Schoenefeld (DE); TYCO ELECTRONICS AMP GMBH, Bensheim (DE)

( * ) Notice: Subject to any disclaimer, the term of this patent is extended or adjusted under 35 U.S.C. 154(b) by 114 days.

(21) Appl. No.: 14/008,606

(22) PCT Filed: Mar. 26, 2012

(86) PCT No.: PCT/EP2012/055348

§ 371 (c)(1), (2), (4) Date: Feb. 27, 2014

(87) PCT Pub. No.: WO2012/130812

PCT Pub. Date: Oct. 4, 2012

(65) Prior Publication Data

US 2014/0170876 A1 Jun. 19, 2014

(30) Foreign Application Priority Data

Apr. 1, 2011 (EP) ..... 11002730

(51) Int. Cl.
*H01R 13/629* (2006.01)

(52) U.S. Cl.
CPC .... *H01R 13/62933* (2013.01); *H01R 13/62938* (2013.01)

(58) Field of Classification Search
USPC ..... 439/157–160
See application file for complete search history.

(56) References Cited

U.S. PATENT DOCUMENTS

| | | | | | |
|---|---|---|---|---|---|
| 5,308,254 | A | * | 5/1994 | Hatagishi et al. | 439/157 |
| 5,344,194 | A | * | 9/1994 | Hatagishi et al. | 285/26 |
| 5,575,671 | A | * | 11/1996 | Katsuma | 439/157 |
| 5,797,758 | A | * | 8/1998 | Tsuchiya et al. | 439/157 |
| 6,142,787 | A | * | 11/2000 | Ikesugi | 439/15 |

(Continued)

FOREIGN PATENT DOCUMENTS

| | | | |
|---|---|---|---|
| CN | 1717847 | A | 1/2006 |
| CN | 101356695 | A | 1/2009 |

(Continued)

*Primary Examiner* — Chandrika Prasad
(74) *Attorney, Agent, or Firm* — Leydig, Voit & Mayer, Ltd.

(57) ABSTRACT

Arrangement for establishing and/or breaking a connection between a plug and a complementary mating plug, wherein a lever which can be pivoted about an axis is arranged on the plug. The connection between the plug and the mating plug can be broken when the lever is pivoted into a disconnection position and/or can be established when the lever is pivoted into a connection position. The plug is, in particular, a switch module, for example a tripping module for a mating plug which is in the form of a circuit breaker.

12 Claims, 4 Drawing Sheets

(56) References Cited

U.S. PATENT DOCUMENTS

| | | | | |
|---|---|---|---|---|
| 6,854,992 | B2 | 2/2005 | Martin | |
| 7,090,518 | B1 * | 8/2006 | Osada et al. | 439/157 |
| 7,396,240 | B2 | 7/2008 | Frederiksen et al. | |
| 7,641,486 | B2 | 1/2010 | Tonosaki | |
| 7,686,631 | B1 * | 3/2010 | Eow et al. | 439/157 |
| 8,215,979 | B2 * | 7/2012 | Shamoto et al. | 439/372 |
| 2010/0081304 | A1 * | 4/2010 | Titokis et al. | 439/157 |
| 2013/0102172 | A1 * | 4/2013 | Kobayashi et al. | 439/157 |

FOREIGN PATENT DOCUMENTS

| | | | |
|---|---|---|---|
| CN | 101562297 | A | 10/2009 |
| DE | 9404295 | U1 | 7/1995 |
| EP | 0673085 | A2 | 9/1995 |
| EP | 2180558 | A1 | 4/2010 |
| FR | 2948237 | A1 | 1/2011 |
| JP | 1055853 | A | 2/1998 |
| WO | WO 2006020924 | A2 | 2/2006 |
| WO | WO 2010035247 | A2 | 4/2010 |

* cited by examiner

ARRANGEMENT FOR ESTABLISHING AND BREAKING A CONNECTION BETWEEN A PLUG AND A MATING PLUG BY PIVOTING LEVER ARRANGED ON THE PLUG

CROSS-REFERENCE TO RELATED APPLICATIONS

This application is a U.S. National Stage application under 35 U.S.C. §371 of International Application No. PCT/EP2012/055348, filed on Mar. 26, 2012, and claims benefit to European Patent Application No. 11002730.7, filed on Apr. 1, 2011. The International Application was published in German on Oct. 4, 2012, as WO 2012/130812 A1 under PCT Article 21(2).

FIELD

The invention concerns an arrangement with a plug and a complementary mating plug, for creating and/or detaching the connection between the plug and the mating plug, whereby a lever is arranged on the plug, which is pivoted around a shaft. The connection of the plug with a counter plug can be detached by pivoting the lever into a detaching position and/or created by pivoting the lever into a connecting position. The plug is especially a switch module, for instance a trigger module for a mating plug designed as a circuit breaker.

BACKGROUND

Such arrangements of plugs and complementary mating plugs, especially of circuit breakers with trigger modules, are used with switching devices, switches and especially switches with accessories, such as adapters, among other things. The connection of a plug with a complementary mating plug, each with several pins that can be connected to electrical conductors, is generally created or detached by plugging in or removing by hand.

The use of a pivoted lever for connecting the plug with a complementary mating plug is, for instance, known from DE 94 04 295 U1 and serves to lock the connection as soon as it is created. By swivelling the lever that is arranged on the plug or on the mating plug, it engages—using a locking curve—an engagement spigot on the other part and in this manner, locks the plug and mating plug in the connected position. A disadvantage here is that plugging in the plug into the mating plug depending on the type of the plug and, for instance, the number and design of the pins to be connected requires considerable force, which needs to be provided in order to be able to create the lock. The requirement of force hereby rises during the plugging-in process, as the pins increasingly mesh, causing an increase in friction. If the requirement of force is, say, 120 newton, in the region of a few millimeters of the fully plugged-in position, there exists a considerable risk of injury when connecting and especially when removing the plug connection by hand. If, for instance, a trigger module in a structurally unfavourable position of a switching device needs to be removed overhead from a circuit breaker by a person standing on a ladder, the sudden disconnection can easily lead to a fall.

SUMMARY

In an embodiment, the present invention provides an arrangement for making and breaking a connection. The arrangement includes: a first plug; a mating plug complementary to the first plug; a lever configured to pivot around a shaft arranged on the first plug; a projection disposed on the lever; a connection contour disposed on the lever; and a spigot disposed on the mating plug. The lever includes a fork, and the connection contour and the projection are arranged on different arms of the fork. A connection of the first plug to the mating plug is created by pivoting the lever into a connecting position by transferring force from the connection contour onto the spigot. The connection of the first plug to the mating plug is detached by pivoting the lever into a detaching position by transferring force from the projection onto the mating plug.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
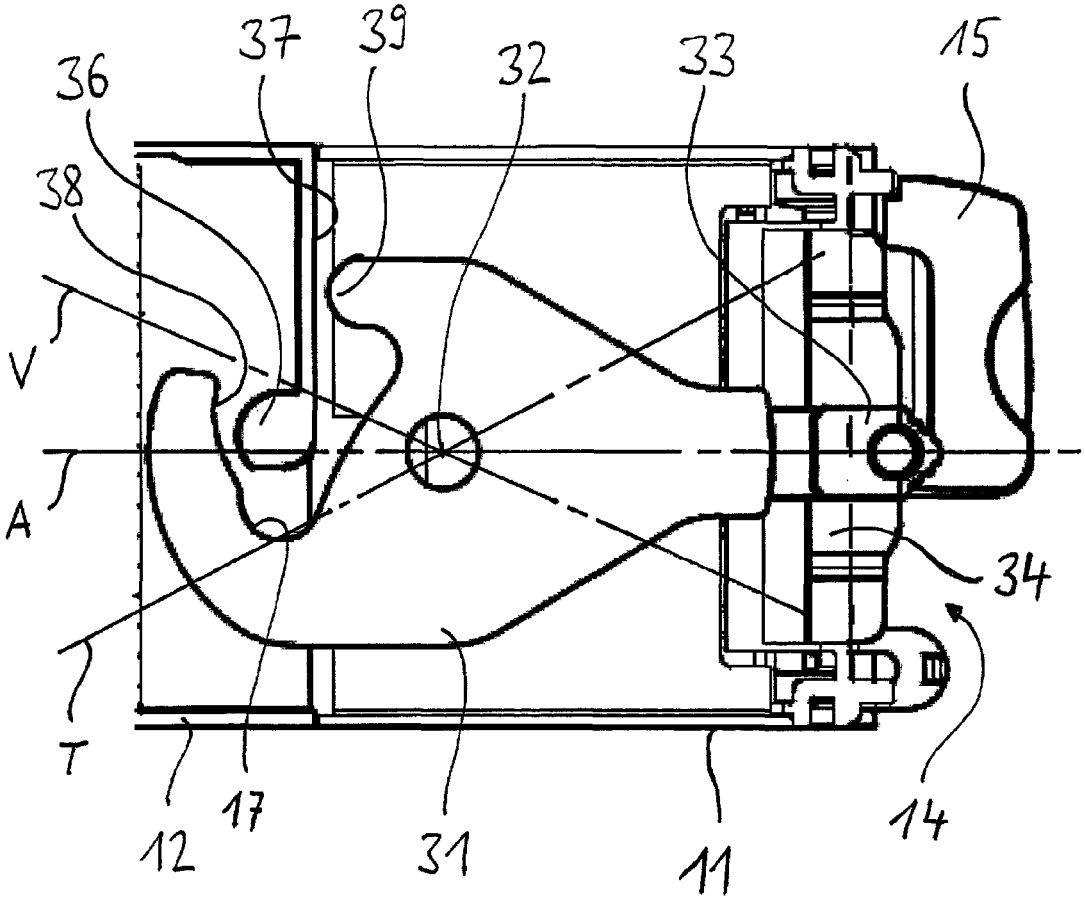
FIG. 1 is a cross-sectional representation of an embodiment of an arrangement according to the invention.

An aspect of the invention is to simplify the creation and/or detachment of a connection between a plug and a mating plug especially in that a considerably large force is not required for creating or detaching the connection.

The arrangement according to the invention with a plug and a complementary mating plug is provided for creating and/or detaching a connection of the plug with the mating plug, whereby a lever pivoted around a shaft is arranged on the plug. The terms plug and mating plug within the meaning of the invention are not absolute as to what is the push-in part and what is the receptacle. Preferably, the plug should generally be an exchangeable switch module, especially a trigger module, which ideally interacts with a circuit breaker, whereby the circuit breaker forms or features the mating plug.

The plug is especially developed for receiving a plug insert with several pins and the mating plug for receiving a mating plug insert with several complementary pins, whereby each of the pins can be connected to electrical conductors.

The fact that the lever is provided with a projection enables the connection of the plug with the mating plug to be detached by pivoting the lever into a detachment position by means of a transfer of force from the projection onto the mating plug. An advantage of the solution according to the invention is that in order to overcome the considerable force for plugging in or withdrawing the projection, a leverage effect is transferred to the mating plug, which enables a simplified and more secure detachment of the connection.

In this regard, the projection is especially formed and arranged such that the plug and the mating plug are separated from one another from their connection position by a gap such that additional separation by hand becomes possible without risk of injury, namely, without considerable force. This gap, by which the plug and the mating plug are separated from one another from their connected position is preferably less than 10 millimeters, ideally less than 6 millimeters. Generally, the gap is optimally around 4 millimeters. An expert will recognise that gaps of less than 1 millimeter generally do not permit any meaningful detachment of the plug from the mating plug.

According to a preferred embodiment, the transfer of force from the projection onto the mating plug takes place directly onto the housing of the mating plug. This is an advantage in that no additional counter bearing is required on the mating plug.

As an alternative or preferred solution to the problem, an arrangement is provided for, which has the plug and the complementary mating plug, and is likewise provided for creating and/or detaching a connection between the plug and the mating plug, whereby the plug has an arrangement comprising a lever pivoted around a shaft, and according to the invention, the lever has a connection contour and the mating plug has a spigot, whereby the connection between the plug and the mating plug can be created by pivoting the lever into a connecting position by transferring force from the connection contour onto the spigot. An advantage of this arrangement is that large plug-in forces that arise especially over a stretch of the plug-in path directly before attaining the final connected position can be easily and safety brought about by pushing the lever into the connecting position. For this purpose, the connection contour is formed such that the spigot, and thus the mating plug, are advanced towards the plug or vice versa. An engagement recess arranged behind the connection contour in the pivot direction for purposes of locking advantageously enables the lever to be engaged when the connection between the plug and mating plug is created, if the spigot can be engaged in the engagement recess. This engagement or locking is however not essential for fulfilling the purpose of the invention. Preferably, the arrangement would rather have a lock independent of the lever, which can be locked only after the connection is created, or which cannot be opened when the mating plug, designed as a circuit breaker, is in the switched-on state, such that the replacement of a plug designed as a switch module, especially a trigger module, is not possible.

According to the preferred embodiment of both variants, it is provided for that the lever has an actuation grip on one side for pivoting the lever around the shaft, whereby the connection contour and/or the projection are arranged on the opposite side of the lever. In a combination of both variants, the lever preferably has a fork, whereby the connection contour and the projection are arranged on different arms of the fork.

According to another preferred embodiment of both variants, the lever can be pivoted between the connecting position and the detaching position over an angular range of less than 90°, preferably over an angular range of less than 60°, ideally an angular range of less than 45°. Smaller pivot angles allow the actuation grip to be guided along only one side of the plug's housing, which is advantageous in case of limited structural space, which is commonly the case in switching devices, say, in industrial systems.

According to another preferred embodiment of both variants, the actuation grip of the lever is guided into a guide coulisse on one actuation side of the plug. Ideally, the actuation grip should be engaged in the connecting position and/or the detaching position. It is thus possible to clearly ascertain from the actuation side of the plug whether the connection has been created or detached or, if required, is in an undefined interim position. The actuation side of the plug is generally assigned to the operator and is located opposite the pins, for instance.

According to another preferred embodiment of both variants, the actuation side of the plug can be covered at least partially by a pivoted cover, whereby the cover has a lock, such that the cover can be pivoted into a position covering the actuation side only if the actuation grip is in the connecting or detaching position, that is, especially engaged. If the status of the plug connection is unclear, the actuation grip will be in an interim position, such that the lock prevents the actuation side from being covered. A preferred embodiment that prevents accidental errors has ramps on the edges of the lock, whereby the ramps are provided to displace the actuation grip into the connecting position or detaching position. This is evidently possible on if the actuation grip is already nearly in the connection position or nearly in the detachment position and needs to be shifted only by a very small angular range of, say, less than 10°, especially less than 5°.

In case of a mating plug designed as a switch, especially a circuit breaker, the switch can be switched on only if the cover of the actuation side of the plug or the switch module is closed. The closed cover guarantees a definite state of the plug connection, namely either completely connected or completely detached, so that switching on the switch does not entail the risk of there being an incompletely set up connection, which could lead to damage to the electrical appliance. In the detached state, the lever held in the detaching position when the cover is closed also advantageously serves as a transportation lock.

FIG. 1 shows an embodiment of an arrangement according to the invention with a plug 11 and a complementary mating plug 12 for creating and/or detaching a connection between the plug 11 and the mating plug 12. A lever 31 pivoted around a shaft 32 is arranged on the plug 11. In the design example shown, the plug 11 has a generally replaceable switch module, especially a trigger module, which ideally interacts with a circuit breaker, whereby the circuit breakers forms the mating plug 12. The lever 31 with a longitudinal shaft A is shown in an interim position, in which the connection between plug 11 and mating plug 12 is neither created nor detached. The lever 31 can be adjusted with the actuation grip 33, whereby the adjustment path is limited by a coulisse 34, in which the actuation grip 33 is guided to one actuation side 14 of the plug 11. If the lever 31 is pivoted into a detaching position T, in which the shaft A lies more or less along the line marked T, the fact that a projection 39 is provided on the lever 31 enables the connection of the plug 11 with the mating plug 12 to be detached by transferring force from the projection 39 onto the mating plug 12. The transfer of force from the projection 39 onto the mating plug 12 preferably takes place directly onto a housing 37 of the mating plug 12. The lever 31 is especially designed as a flat component, which is essentially oriented in parallel to a housing wall of the plug 11 or the mating plug 12.

The lever 31 also has a connection contour 38 and the mating plug 12 has a spigot 36, whereby the connection of the plug 11 with the mating plug 12 can be created by pivoting the lever 31 into a connecting position according to the line marked V. When pivoting the lever 31 into the connecting position V, the shape of the connection contour 38 results in a transfer of force from the connection contour 38 onto the spigot 36, by which the plug 11 and the mating plug 12 move towards one another, say, over a stretch of 4 millimeters, whereby the region of greatest force is overcome. An engagement recess 17 arranged behind the connection contour 38 in the pivot direction towards the connecting position V advantageously allows an additional engagement of the lever 31 when the connection between the plug 11 and mating plug 12 is set up, by engaging the spigot 36 in the engagement recess 17.

A rotary knob 15 on the circuit breaker 12 will be described later in greater detail in connection with the FIGS. 3 and 4.

Figure 2:
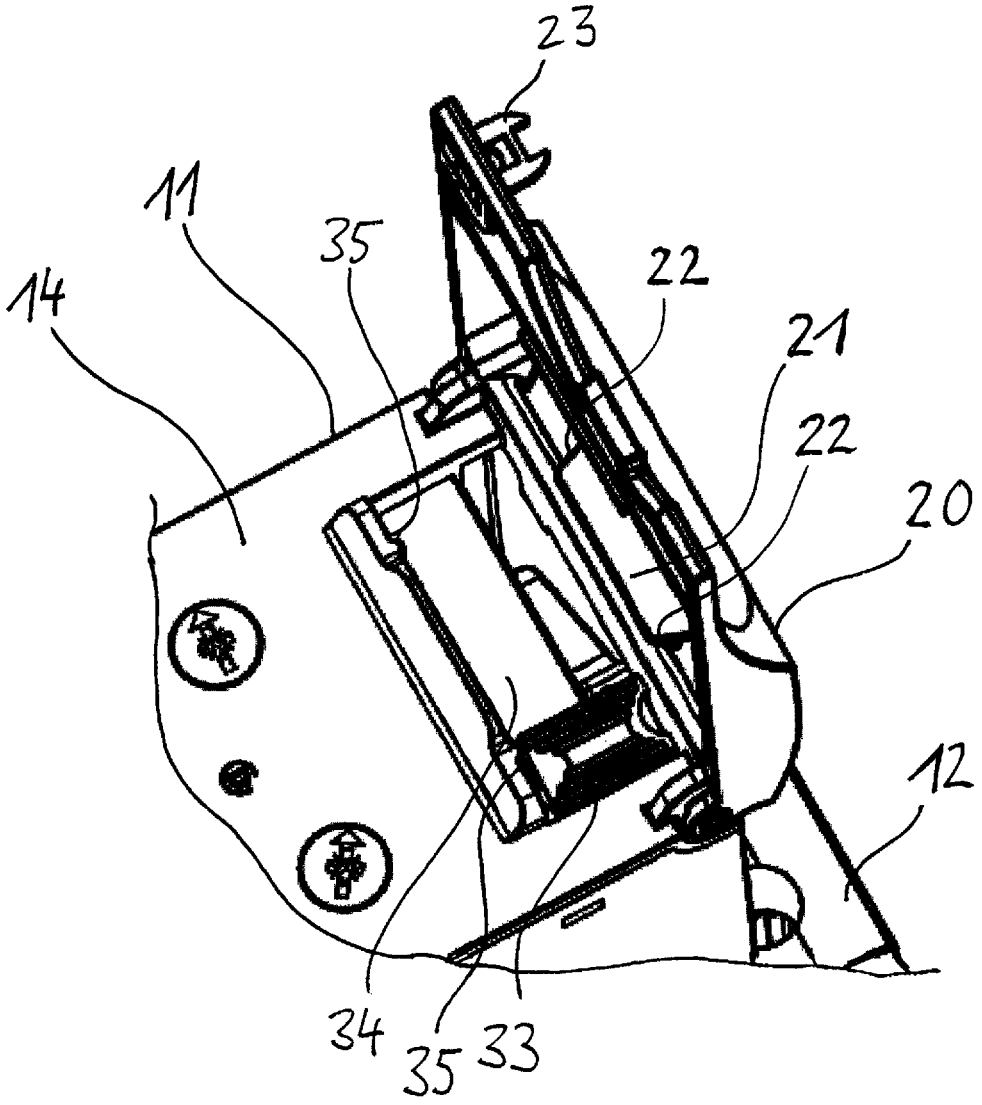
FIG. 2 is a perspective view of the embodiment according to FIG. 1 with the cover open.

FIG. 2 shows a partial perspective view of the arrangement according to FIG. 1 on the actuation side 14 of the plug 11. The mating plug 12 is visible in the background. The coulisse 34 serves to guide the actuation grip 33 of the lever 31, most of which is covered. At both its end positions, the coulisse 34 has engagement means 35, which allow engaging the actuation grip 33 in the connecting position or the detaching position. The plug 11 has a pivoted cover 20, which can cover the actuation side 14 in its closed state at least partially. FIG. 2 shows the cover 20 in an opened position. A lock 21 with side ramps 22 prevents the cover 20 from closing as long as the actuation grip 33 is outside the end positions. A tab 23 helps to engage the cover 20 with the mating plug 12 in the closed position, as explained below in connection with FIG. 3.

Figure 3:
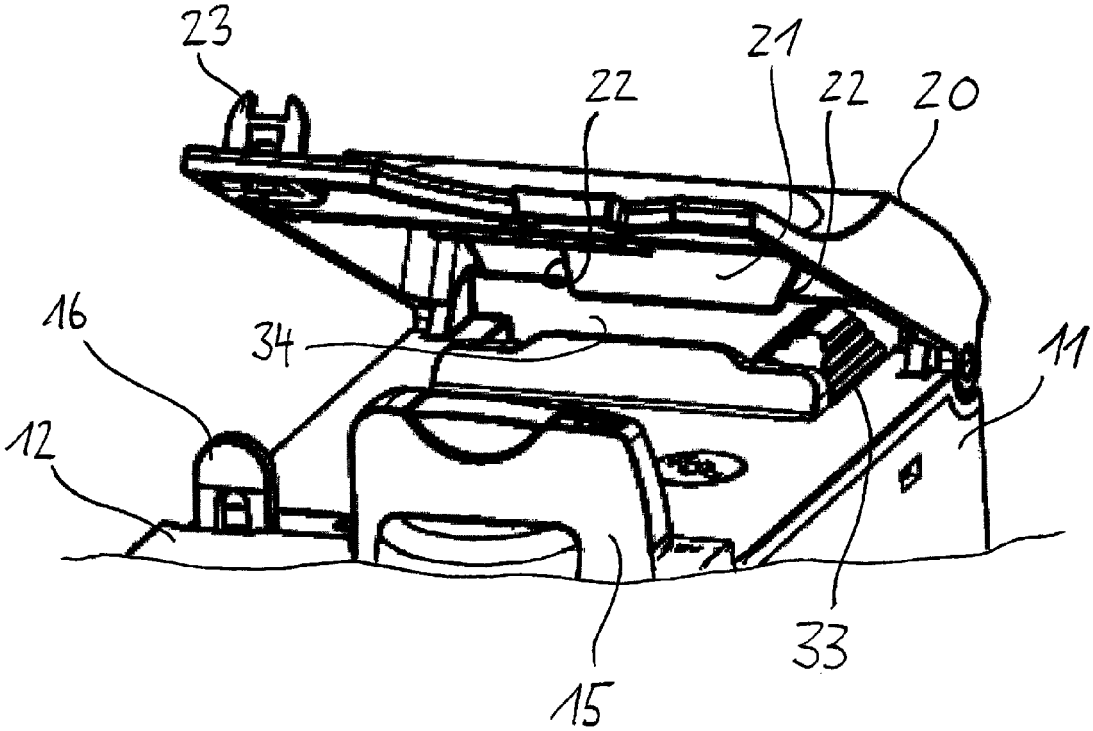
FIG. 3 is a perspective view of the embodiment according to FIG. 1 with the cover incompletely closed.

FIG. 3 shows another perspective view of the actuation side 14, with the cover in a nearly closed position, from which it can also be inferred that the lock 21 would collide with the actuation grip 33 if it is not positioned in one of the end positions. This advantageously prevents the cover 20 from being closed when the state of the connection between the plug 11 and the mating plug 12 is unclear. Only if the cover 20 is closed can the rotary knob 15 on the mating plug 12 once again rotate to its switched-on position. Furthermore, the mating plug 12 has a counter tab 16 for engaging with the tab 23 on the cover 20, by which the cover 20 is secured in the closed position, especially for as long as the rotary knob 15 is not shifted to the switched-on position. In the switched-on position, the rotary knob 15 rises over the cover 20 and likewise secures it in the closed position.

Figure 4:
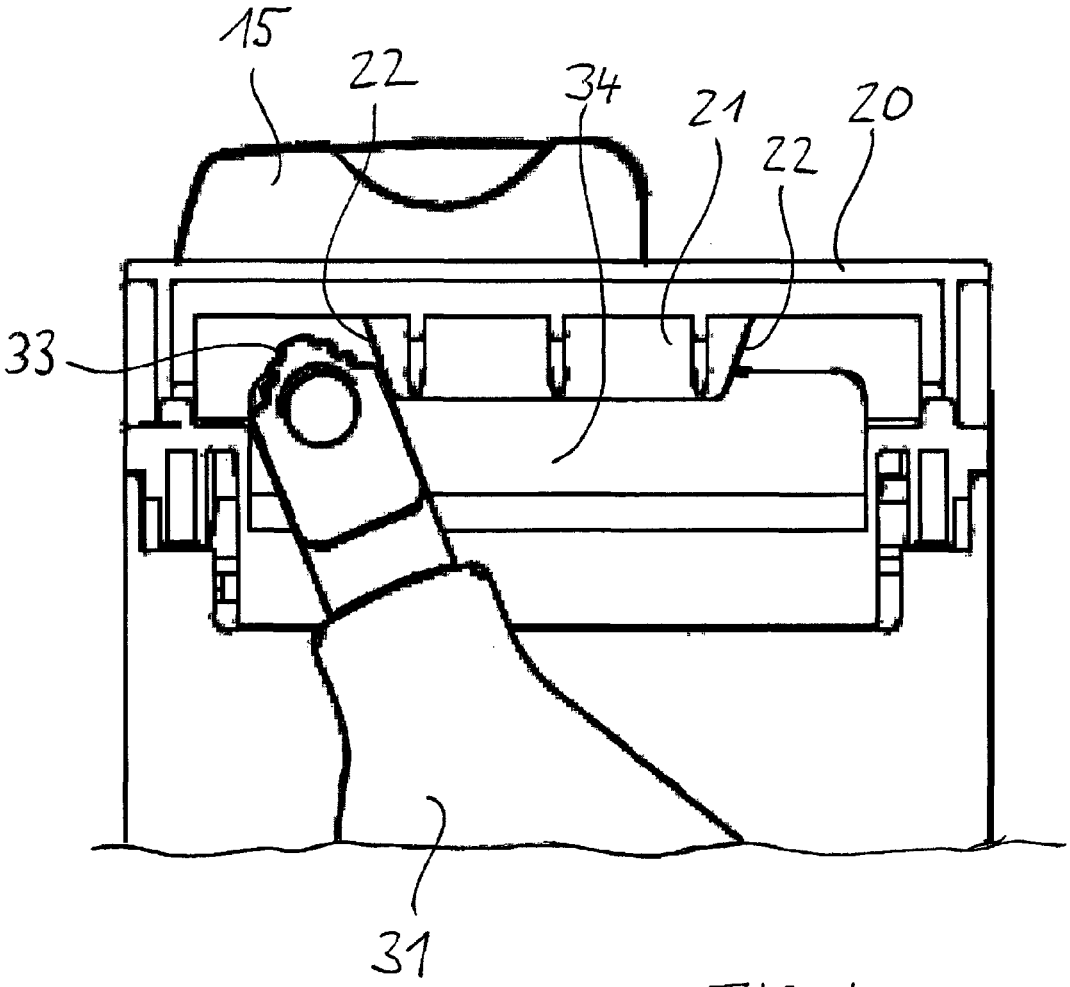
FIG. 4 is an enlarged partial view according to FIG. 1 with the cover closed.

FIG. 4 shows a cross-section view according to FIG. 1, whereby the region of the coulisse 34 on the plug 11 is visible in as an enlarged partial view. The cover 20 is in the closed position. Here, the function of the ramps 22 on the web-shaped lock 21, which is provided for shifting the actuation 33 into one of the end positions, only in case it is nearly in one of the end positions when closing the cover 20, whereby on the one hand, a certain tolerance range is advantageously created, and on the other hand, the deviation is comprehensively corrected by the ramp 22. Finally, the ramps 22 or the lock 21 also cause a locking of the lever 31 in the locking position or in the detaching position, as long as the cover 20 remains closed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SYMBOLS

11 Plug, especially trigger module
12 Mating plug, especially circuit breaker
14 Actuation side
15 Rotary knob
16 Counter tab
17 Engagement recess
20 Cover
21 Lock
22 Ramp
23 Latch
31 Lever
32 Shaft
33 Actuation grip
34 Coulisse
35 Engagement means
36 Spigot
37 Housing of mating plug
38 Connection contour
39 Projection
A Shaft
T Detaching position
V Connecting position

The invention claimed is:

1. An arrangement for making and breaking a connection, the arrangement, comprising:
a first plug;
a mating plug, complementary to the first plug;
a lever, configured to pivot around a shaft arranged on the first plug;
a projection disposed on the lever;
a connection contour disposed on the lever; and
a spigot disposed on the mating plug,
wherein the lever includes a fork, the connection contour and the projection being arranged on different arms of the fork,
wherein a connection of the first plug to the mating plug is created by pivoting the lever into a connecting position so as to transfer a connecting force from the connection contour onto the spigot, and
wherein the connection of the first plug to the mating plug is detached by pivoting the lever into a detaching position so as to transfer a detaching force from the projection onto the mating plug.

2. The arrangement of claim 1, wherein the detaching force from the projection onto the mating plug is directly transferred onto a housing of the mating plug.

3. The arrangement of claim 1, wherein the lever includes an actuation grip on one side of the shaft suitable for pivoting the lever around the shaft,
wherein an opposite side of the lever includes at least one of the connection contour and the projection.

4. The arrangement of claim 1, wherein the lever can be pivoted between the connecting position and the detaching position over an angular range of less than 90°.

5. The arrangement of claim 4, configured such that the lever can be pivoted between the connecting position and the detaching position over an angular range of less than 60°.

6. The arrangement of claim 5, configured such that the lever can be pivoted between the connecting position and the detaching position over an angular range of less than 45°.

7. The arrangement of claim 1, further comprising:

an actuation grip on the lever, wherein the actuation grip is guided in a guide coulisse on one actuation side of the first plug, and wherein the actuation grip is configured to be engaged in at least one of the connecting position and the detaching position.

8. The arrangement of claim 7, wherein the actuation side of the first plug is configured to be covered at least partially by a pivoted cover, and wherein the pivoted cover includes a lock, configured such that the pivoted cover can be pivoted into a position covering the actuation side only if the actuation grip is in the connecting position or the detaching position.

9. The arrangement of claim 8, wherein the lock includes a ramp, wherein the ramp is configured to shift the actuation grip into the connecting position or into the detaching position.

10. The arrangement of claim 8, wherein the lock includes a plurality of ramps, wherein the plurality ramps are configured to shift the actuation grip into the connecting position or into the detaching position.

11. The arrangement of claim 1, wherein the first plug is a switch module and the mating plug is a circuit breaker.

12. The arrangement of claim 11, wherein the circuit breaker can be switched only if a cover of the switch module is closed.

* * * * *